US007240628B2

(12) United States Patent
Friman et al.

(10) Patent No.: US 7,240,628 B2
(45) Date of Patent: Jul. 10, 2007

(54) THREAD FEED FOR A SEWING MACHINE

(75) Inventors: Bertil Friman, Tenhult (SE); Åke Jönsson, Jönköping (SE); Henrik Eklund, Huskvarna (SE)

(73) Assignee: VSM Group AB, Huskvarna (SE)

( * ) Notice: Subject to any disclaimer, the term of this patent is extended or adjusted under 35 U.S.C. 154(b) by 115 days.

(21) Appl. No.: 11/079,293

(22) Filed: Mar. 15, 2005

(65) Prior Publication Data

US 2005/0199165 A1 Sep. 15, 2005

(30) Foreign Application Priority Data

Mar. 15, 2004 (SE) ..... 0400632

(51) Int. Cl.
*D05B 1/00* (2006.01)

(52) U.S. Cl. ..... 112/475.01

(58) Field of Classification Search ..... 700/136–138; 112/475.01, 301

See application file for complete search history.

(56) References Cited

U.S. PATENT DOCUMENTS

| | | | | |
|---|---|---|---|---|
| 4,364,319 | A | 12/1982 | Niehaus et al. | |
| 4,408,554 | A | 10/1983 | Takiguchi et al. | |
| 4,702,185 | A * | 10/1987 | Hanyu et al. | 112/254 |
| 4,967,679 | A | 11/1990 | Hara et al. | |
| 5,105,750 | A * | 4/1992 | Horie | 112/302 |
| 5,216,970 | A | 6/1993 | Sakuma | |
| 5,806,448 | A | 9/1998 | Matsuo et al. | |
| 5,816,175 | A | 10/1998 | Teramoto | |
| 6,012,405 | A | 1/2000 | Melton et al. | |
| 6,092,478 | A * | 7/2000 | Simakrai et al. | 112/278 |

FOREIGN PATENT DOCUMENTS

| | | |
|---|---|---|
| DE | 3102048 C2 | 7/1989 |
| JP | 4135594 | 5/1992 |
| JP | 6134163 | 5/1994 |
| WO | WO 00/68483 A1 | 11/2000 |

* cited by examiner

*Primary Examiner*—Danny Worrell
(74) *Attorney, Agent, or Firm*—Venable LLP; Eric J. Franklin

(57) ABSTRACT

A sewing machine including a needle being supplied with an upper thread, a loop taker which accommodates a bobbin for a bottom thread, and a drive unit, which forces the needle to perform a reciprocating movement. The needle, during its movement and in cooperation with the loop taker, executes a stitch on a sewing material being advanced between the upper thread and the bottom thread. A take-up lever, for each stitch, pulls tight a knot being formed in the sewing material by the upper thread and the bottom thread in cooperation. The sewing machine further includes a thread transfer member supplying the needle with an upper thread with either a thread portioner or a friction braking assembly for friction braking of the upper thread. A switch switches between thread supply with the thread portioner or with the friction braking assembly. A control unit controls the thread supply from the thread portioner or, alternatively, controls the friction braking assembly.

41 Claims, 8 Drawing Sheets

THREAD FEED FOR A SEWING MACHINE

TECHNICAL FIELD

The present invention is related to a sewing machine and a method for optimization of thread feed for each stitch of a seam performed with the sewing machine. Particularly, the invention presents a device providing a possibility of switching between thread feed by means of a portioning of the upper thread and thread feed by means of friction braking of the upper thread for all types of machine fed seams optional at the sewing machine.

DESCRIPTION OF BACKGROUND ART

To establish a seam on a fabric, today, there exists on the market a number of devices of different designs for performing lock stitches. On common home sewing machines an upper thread and a bottom thread on a bobbin in cooperation with a needle are used, in a known way, to bring the upper thread to perform a lock stitch on the fabric, which is sewn on the sewing machine.

A correct relation between the length of the upper thread and the length of the bottom thread of a stitch is desirable to accomplish a seam that looks decorative and holds a high quality. The proportion between the length of the upper thread and the bottom thread of each stitch depends on the relation between the tension of the upper thread and the bottom thread, respectively, during the forming of a knot that is made by upper thread and bottom thread and which constitutes a lock for a stitch in the seam.

To obtain the desired quality of a stitch, it is desirable that the knot of a stitch can securely be placed at the desired location in relation to the fabric. Usually, an optimal location of the knot is in the middle of the fabric as seen in a cross section of the extension of the fabric.

In prior art it is known to automatically adjust the present thread tension of the upper thread based on thread consumption of former stitches of the seam. Such a device is disclosed, as an example, in document U.S. Pat. No. 6,012,405. In this device the real thread consumption of the upper thread is measured be means of a decoder for consumed thread length after a completed stitch, whereby this information about real thread consumption for an already performed stitch is used to adjust the thread tension of a subsequent stitch to accomplish a correct relation of thread lengths between upper thread and bottom thread. This and other similar solutions presupposes that the amount of upper thread required for a present stitch is known in advance.

Document U.S. Pat. No. 4,967,679 discloses a solution to attain automatic control of thread feed, wherein a sewing machine for straight seams utilizes thread out portioning in accordance with a requisite amount of upper thread, and which adjusts the thread tension of the upper thread at zigzag sewing. The thread out portioning of this solution is mechanically driven, wherein rolls which drive the thread are rotated synchronically with the driving mechanical members of the sewing machine. At zigzag sewing the thread tension is electrically set according to a manually predetermined value.

In this described solution the consumption of upper thread per stitch may not be predetermined for other types of seams than for straight seams. The thread out portioning is effected in dependence of a cyclic movement on a mechanical member of the sewing machine. The selected mechanical member executes the same cyclic movement also for other types of seams, e. g. at zigzag seams, whereby thread may not be fed by means of thread out portioning controlled by said mechanical members other than for straight seams.

However, the possibility to predetermine the thread consumption of upper thread consumption for a subsequent stitch is known. Such a determination takes into consideration, without being limited to these factors, stitch length, the thickness of the fabric, angular deviation between a present and a subsequent stitch, stitch speed and other parameters set by an operator. Such a determination of thread consumption is shown in the publication U.S. Pat. No. 6,012,405, a publication, the content of which in its entirety is incorporated into this description by reference.

Earlier, it has been problematic to use thread out portioning as an alternative to friction braking and to be able to freely switch between these, when in both cases the control unit of the sewing machine shall fulfil the demand to control the out portioning of upper thread and the brake force at friction braking respectively.

The present invention provides a device and a method to render a free choice of thread feed possible by means of a selection of thread out portioning or friction braking for all types of seams performed by the sewing machine.

DESCRIPTION OF THE INVENTION

According to one aspect of the present invention, a sewing machine is provided.

According to a second aspect of the invention, a method is provided.

The thread transfer member for the supply of upper thread to the needle is, as an example, composed of a member for portioning a requisite amount of thread per stitch and of a thread friction braking member designed to set a correct tensile force in the upper thread during each stitch by the exertion of a friction force applied to the thread.

The control unit of the sewing machine includes a processor, which obtains information about parameters set by the operator of the sewing machine and data about present positions of mechanical elements relevant for a correct performance of a chosen seam and which controls the sewing of the sewing machine with these parameters and present positions as a basis. Such control is known and is not part of the invention, whereby it is not described here.

Further, the control unit includes an motor supervised by the processor, where 20 the motor is used to carry out the setting of processor calculated consumption of upper thread per stitch at thread out portioning, alternatively, the setting of brake force at friction braking of the upper thread. The motor is also used to carry out a switch between thread out portioning, friction braking and a neutral position, whereby the motor constitutes the performing element of the switch.

Selectable seams, as used herein, refers to all seams, which an operator can set on a selector switch of the sewing machine, whereby the sewing machine in this way controls the sewing according to the selection. By machine fed seam as utilized herein is meant that a fabric, i.e. generally a cloth, is transported by the sewing machine. A sewing machine may have a selectable position for free-hand transporting of the fabric, whereby a seam performed in this position of the switch in this way is not included in the term machine fed seam.

In those mechanical members which influence the needle to perform the forward and backward movement a shaft of the sewing machine is generally included, e.g. a drive shaft which is rotated by a driving member of the sewing machine or by an auxiliary shaft brought to rotation by the driving shaft. Any of these said shafts may be used as the mechanical member, which performs the movement synchronous with the mentioned movement of the needle, whereby the mechanical member in these cases performs a rotational cyclic movement. In alternative embodiments the mechanical member may be composed of a linearly movable member or of a mechanical member oscillating around a mechanical member oscillating around a point of rotation, whereby, in both cases, these mechanical members are brought to their cyclic movement by the driving members of the sewing machine.

The detection of that point of time, at which the predetermined tensile force in the upper thread is attained, is accomplished by use of an element that detects the point of time of a quick acceleration of the tensile force in the upper thread, which indicates the point of time at which the knot of a stitch is pulled tight. Such an element may be established in multiple ways, for example by use of a thread transfer spring, around which the upper thread is hooked. At a rapid acceleration of the tensile force, which occurs at the beginning of the pull tight of said knot, this spring is rapidly brought to a new position as it is stretched by the upper thread. By a detection of when the change of the position of the thread transfer spring occurs, a value of the point of time for the pull tight of the knot is obtained. The point of time when the predetermined tensile force in the upper thread occurs can by this be established, for example by a dimensioning of the spring force of the thread transfer spring, by its design, choice of material, etc.

The position A of the mechanical member, in an embodiment where the mechanical member includes a rotating shaft, includes that the shaft holds an angle of rotation A, wherein a marking on the shaft coincides with a fixed defined marking of the adjacent rotating shaft. The position B of the mechanical member corresponds to the actual angle of rotation that the shaft holds in relation to the fixed marking at the moment when the predetermined tensile forth is detected.

When a take-up lever, through which the thread is thread on the sewing machine, is moving in a direction to pull the knot tight the upper thread will be stretched. The angle of rotation A for the rotating shaft, when the take-up lever is stretching the upper thread for a correct amount of fed thread is known. By a detection of the real angle of rotation B (which in this example constitutes position B) at which the thread is stretched and then compare the real angle B with the angle A at which the thread would have been stretched for a correct amount of fed thread, a measure of the deviation between theoretically calculated and actual thread consumption can be obtained. Thus, the invention makes it possible to detect if a correct amount of thread, to small amount of thread or to big amount of thread is provided.

One part of the invention is that it is possible to obtain a measure of how much he actual thread consumption deviates from the theoretically correct consumption, whereby it becomes possible to compensate for the deviation by means of an adjustment of the amount of fed thread. The correction of the deviation is carried out by means of a device for portioning the amount of thread fed out, which is controlled to minimize the deviation or by means of a device for friction braking, which is controlled to minimize the deviation. The deviation from the theoretically calculated consumption of thread can, e.g., depend on different elasticity of the thread which is being used or varying efficiency of the feeding at the transport of the sewing material.

A great advantage of embodiments of the invention is that it is possible to choose between a) use of an automatic device for portioning out the thread, i. e. a device which delivers a certain amount of upper thread per stitch and b) feed of upper thread to the needle by means of a unit for friction braking of the upper thread.

Another considerable advantage of embodiments of the present invention is that it becomes possible to select feed of upper thread to the needle adapted to the type of seam, sewing method and sewing material, which is being used for the occasion and that for both alternatives of thread feed to have a possibility to control the deviation between actual and calculated thread consumption towards zero for each stitch.

A further advantage of embodiments of the present invention is that it is possible by means of a switch to freely switch between thread fed out portioning, friction braking and a neutral position, wherein the upper thread is disengaged. A user can decide himself the type of thread feed that shall be utilized for machine controlled seams.

Earlier it has not existed any method for obtaining information about deviation between theoretical or actual thread consumption for a present stitch, i. e. for the stitch that is presently sewn by the machine, wherein a detected deviation immediately can be used for a regulation of the deviation for all types of seams.

One way to establish a thread out portioning is to use a step motor, which runs drive rolls bearing on each other and the thread and transports thread in dependence of the stepping of the motor. Further, this allows adjustment of the thread consumption of a present stitch. If, e. g., the detected deviation indicates that too much thread is transported during the present stitch, the step motor can, at the end of a stitch, be reversed some steps to thereby, by means of the drive rolls, withdraw thread which has already been fed out. Normally, the adjustment is carried out to minimize, by controlling in a subsequent stitch, a deviation of the thread transport which at the moment, i. e. for the time being, prevails.

Further features of the present invention are disclosed in the detailed description below and shall be interpreted in combination with the attached drawings. It must be stressed upon that the drawings are reproduced only for the purpose of being illustrative and are not limiting the invention. The drawings are not performed to scale and they only show conceptual structures and procedures herein.

DESCRIPTION OF EMBODIMENTS

Below, a number of embodiments are described and supported by the enclosed drawings.

By way of introduction the function for the control of thread feed in accordance with two alternatives is presented.

Figure 1:
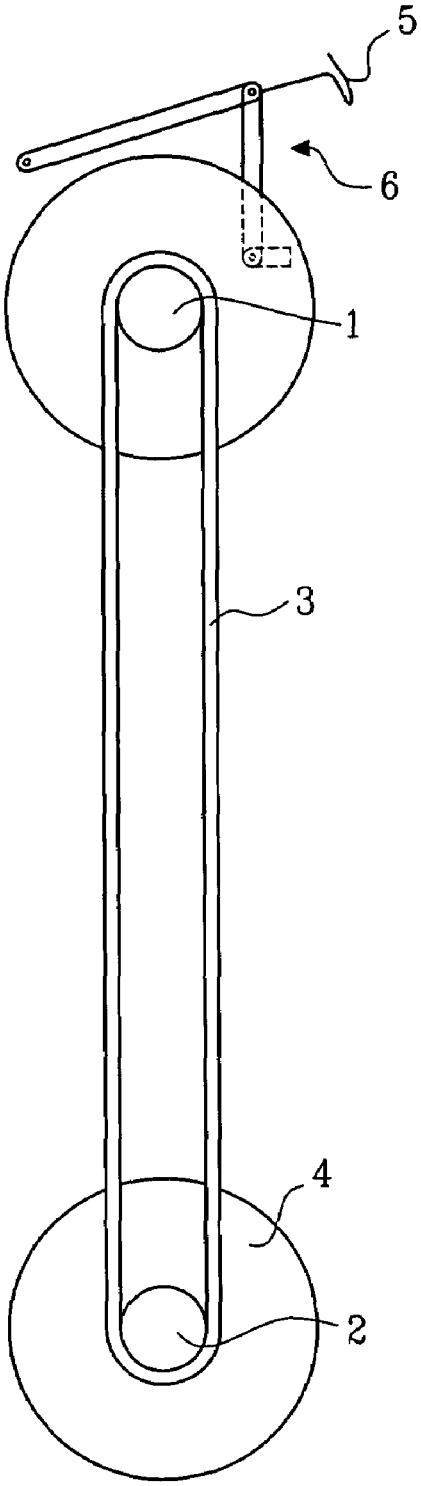
FIG. 1 schematically shows the drive of a sewing machine with two, by means of a belt, united main shafts, which rotates one revolution for each stitch that the machine carries out.

In FIG. 1, a functional configuration of the drive of a sewing machine is schematically shown. A first main shaft driven by a drive motor (not shown) is denoted by 1. A second main shaft is arranged together with the first main shaft. The second main shaft 2 is driven by the first main shaft by means of a drive belt 3. An angular sensing element, here called a position sensor 4, is mounted on the second main shaft. The movement of a take-up lever 5 of the sewing machine is achieved by means of a mechanical coupling between the first main shaft 1 and the take-up lever (5). Such a mechanical coupling is conventional and the details included in the coupling are all together denoted by the arrow 6. The first main shaft 1 is further driving a needle 7, through which an upper thread 8 is thread as is shown below in FIG. 2.

A sewing material is transported forward in a known way, in the form of a fabric 9, between a bottom thread and an upper thread for the performance of a seam, which is built up by desired stitches. The fabric is transported, according to the example, across a sewing table 10, which further houses a bottom thread bobbin enclosed in a loop taker (not shown). To carry out a stitch, in this example a lock stitch, the needle 7 is moved in a reciprocating movement controlled by the first main shaft 1, so that the needle 7 conveys the upper thread down through the fabric, whereby the loop taker conveys the upper thread 8 around the bobbin, which houses the bottom thread, whereby a knot is accomplished in the fabric 9, when the needle again is brought up through the fabric and the loop taker 5 pulls the knot of the stitch tight.

The upper thread is fed out through a thread transfer member 11, which distributes thread to the take-up lever 5 via a thread transfer spring 12, which is tightened when the tensile force in the upper thread exceeds a certain value.

A control program, which is stored in a processor C is a part of the machine. The control program obtains information about the angle of rotation of the second main shaft 2. As both of the main shafts are coupled to each other and, further, as the take-up lever and needle 7 are controlled by the movement of these shafts, the movements of the main shafts, the take-up lever 5 and the needle 7 are synchronized to one another in a cyclic movement pattern, whereby the control program, further, can obtain information about the positions of the take-up lever 5 and the needle 7 of the cyclic lapse. In technology, as is earlier mentioned, it is known to predetermine the consumption of thread per stitch by a calculation of stitch parameters for stitches, which are present of a chosen seam. Such a calculated and thus predetermined thread consumption per stitch is performed in the processor of the sewing machine according to the invention and constitutes the basis for the feed of the motor which executes the thread out portioning as well as the friction braking.

Figure 3:
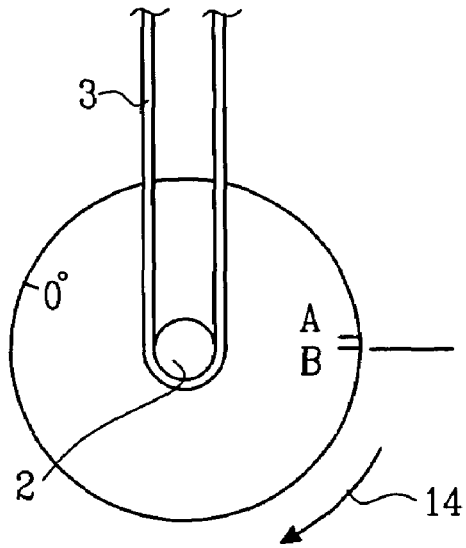
FIG. 3 illustrates the position of the actual value for the main shaft according to FIG. 3 at the pull tight of a knot.
Figure 4:
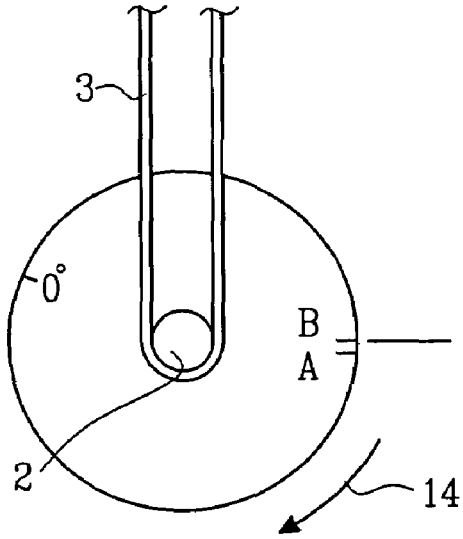
FIG. 4 illustrates the position of the set point for the main shaft according to FIG. 3 at the pull tight of the knot.

A position for any mechanical element, which takes part of the cyclic movement in the sewing machine can be detected by means of a position detector. As one example of a position detector, there is shown how the movement for the mentioned thread transfer spring 12, included in the point of time indicator 13, is used to determine the point of time at which the thread 8 is pulled tight during performance of a stitch. In the example of FIGS. 3 and 4 there is shown a detector where the angle of rotation of the second main shaft 2 is utilized as the mechanical element for which the mentioned position is detected as the actual angle of rotation of the shaft.

Figure 2:
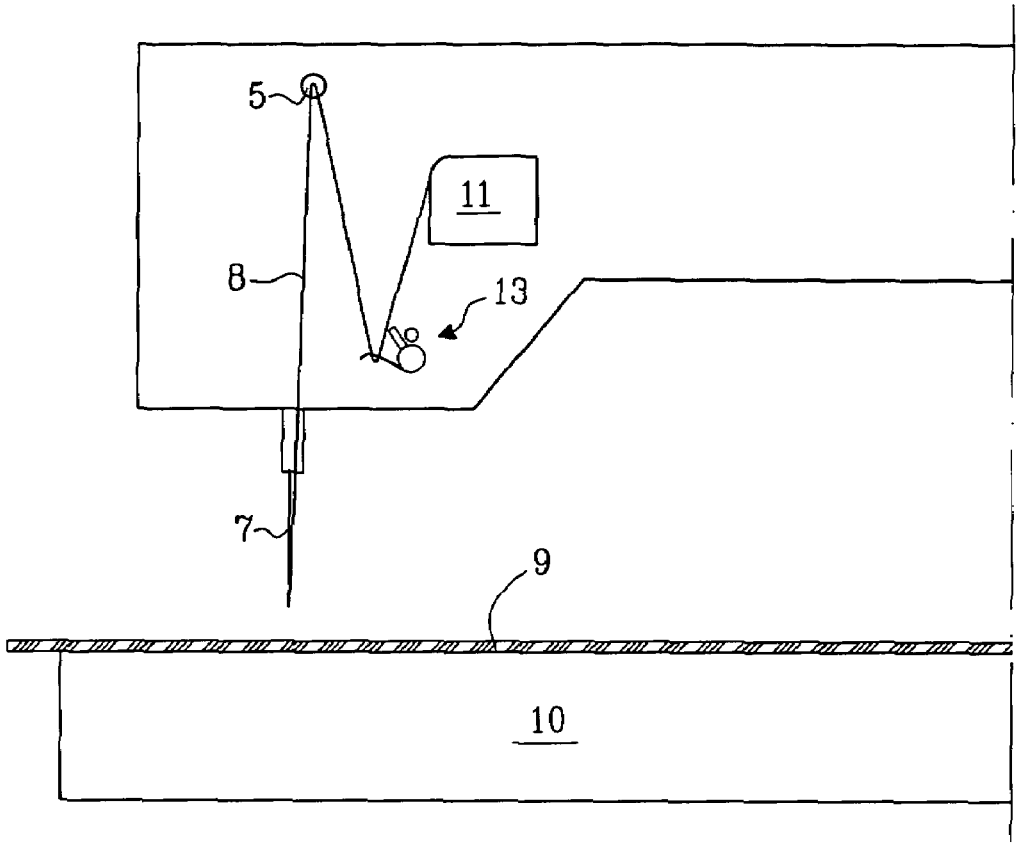
FIG. 2 shows a model sketch of a sewing machine with a thread transfer member and a point of time indicator for determining the point of time of a pull tight of a knot of a stitch.

When the take-up lever of FIG. 2 is moving upwards the upper thread 8 will be stretched to pull tight the knot of an actual stitch. The rotational angle A, for which the take-up lever 5 is stretching the upper thread 8 for a correctly fed out thread is known. By detecting at which angle of rotation B the upper thread is actually stretched and then comparing the actual angle B with the angle A for which the thread should have been stretched for a correct amount of thread being fed out, a measure of the deviation between theoretical and real thread consumption can be obtained.

In FIGS. 3 and 4 it is symbolically shown how an actual value and a set value for the angle of rotation of the positions sensor 4 can be obtained. The direction of rotation is indicated by means of the arrow 14 and is measured, as an example, from a zero reference, which in the figure has been marked with 0°. If the angle of rotation B is greater than the angle of rotation A (FIG. 3), i. e. that the thread has become stretched later than desired, a smaller amount of thread has been consumed than intended. The value of the angle difference A−B gives a measure of the deviation of the thread consumption. When the angle B is less than the angle A (see FIG. 4) a greater amount of thread than calculated has been consumed. The value of the angle difference A−B also in this case gives a measure of the deviation of the thread consumption but with the sign reversed. When a measure of how much the true thread consumption deviates from the theoretically correct one and what sign the deviation has, this obtained deviation can be used to compensate for the deviation by arranging the sewing machine to automatically regulate the amount of thread being fed out. This can be done by a use of the value of the deviation to control the thread transfer member 11 by means of a correction of the value of thread consumption theoretically calculated in the processor.

In FIGS. 3 and 4 the position of the angle of rotation A is only symbolically described. As a matter of fact, the set value A varies in dependence of a number of parameters, such as length of stitch, thickness of fabric, width of stitch, etc., from which a real set value of an actual stitch is determined in the processor.

The detection of the position B is, according to the invention, based on the fact that a predetermined point of time for the pull tight of the knot of each stitch can be determined, whereby this point of time in a way is associated to a measurable point of time of a time interval, during which the pull tight of the knot occurs. Simply expressed, a comparable value of the point of time for the pull tight of the knot of the respective stitch is required. One example of how this can be accomplished is shown by reference to FIG. 5. In this figure, it is illustrated by means of a curve, very schematically, how the tensile force F of the upper thread of a sewing machine varies as a function of the time T. When the pull tight of the knot of a stitch begins, the tensile force F of the upper thread rises steeply, which is evident from the figure. After the pull tight of the knot the tensile force reverts to a low value, i. e. the thread is slackened. A point of time indicator is arranged to determine the point of time, at which the tensile force F of the upper thread reaches a value P set in advance.

Figure 6A:
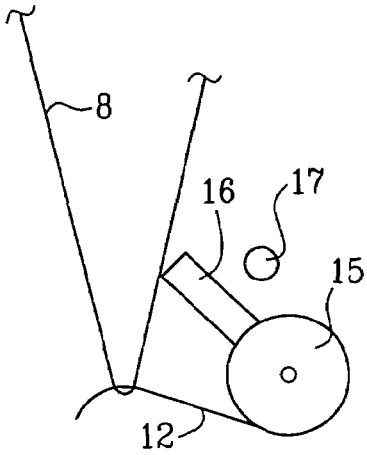
FIGS. 6*a* and 6*b* show two different positions for the point of time indicator, wherein it is illustrated how a light beam is stopped by a flag at the point of time t.

The point of time indicator 13 is, according to one embodiment, provided in the form of a component, which is activated at the time of point t of the process of pull tight of the knot, when the tensile force in the upper thread reaches the value P set in advance. According to the example, the point of time indicator 13 comprises the earlier mentioned thread transfer spring 12. The point of time indicator 13 and its function is illustrated more clearly by means of FIGS. 6*a* and 6*b*. The thread transfer spring 12 is attached to a rotatable wheel 15. A flag 16 is attached to the wheel 15 radially outwards from the wheel. When the upper thread 8 is slackened, i. e. that the tensile force in the upper thread is small, the thread transfer spring 12 is situated in the position that is shown in the FIG. 6*a*. Then, the flag 16 does not block a light beam, which is transmitted crosswise the flag 16 from a light source, not shown, and received by a light detector, which is, further, not shown, as both these devices are known within technology.

Figure 6B:
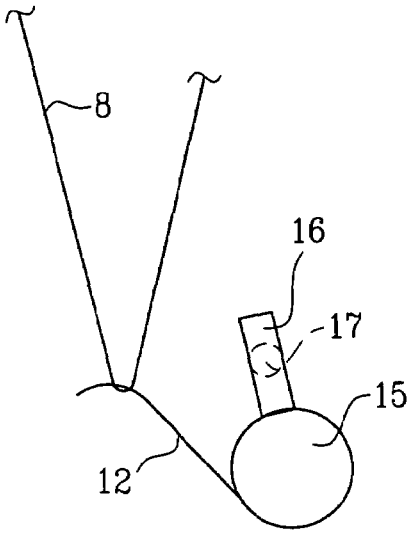

When a knot is pulled tight by means of the take-up lever 5, the tensile force rises quickly in the upper thread, which implies that the thread transfer spring 12 is pulled upwards by the upper thread according to FIG. 6*b*. When the thread transfer spring 12 in this way is pulled upwards the wheel 15 is rotated by the said spring, whereby the flag 16 is brought to a new position, where the flag blocks the light beam 17 as is shown in FIG. 6*b*. The point of time t, at which the light beam 17 is blocked, is registrated by the processor of the sewing machine, whereby a detection of the position B at the pull tight of the knot of the present stitch can be carried out through a reading of the angle of rotation of the position sensor 4 by means of the processor at the point of time t. The set, predetermined value P of the tensile force is designed through a dimensioning of the spring forces of the thread transfer spring 12 and a spring associated with the wheel 15 for back springing the movable parts of the point of time indicator 13 to the position, illustrated in FIG. 6*a*, where the tensile force in the upper thread is once again small.

Point of time indicators of the shown type can, of course, be established in a multiple of different ways. Thus, it is quite possible to utilize a spring loaded light wheel, around which the upper thread is running and wherein the point of time of a movement of the spring loaded wheel caused by the increasing tensile force in the upper thread during pull tight of a knot can be detected. Every device, which is used to detect a point of time of an increased tensile force in the upper thread caused by a pull tight of the knot can be used as a component for sensing the time, i.e. to register the point of time t.

Figure 5:
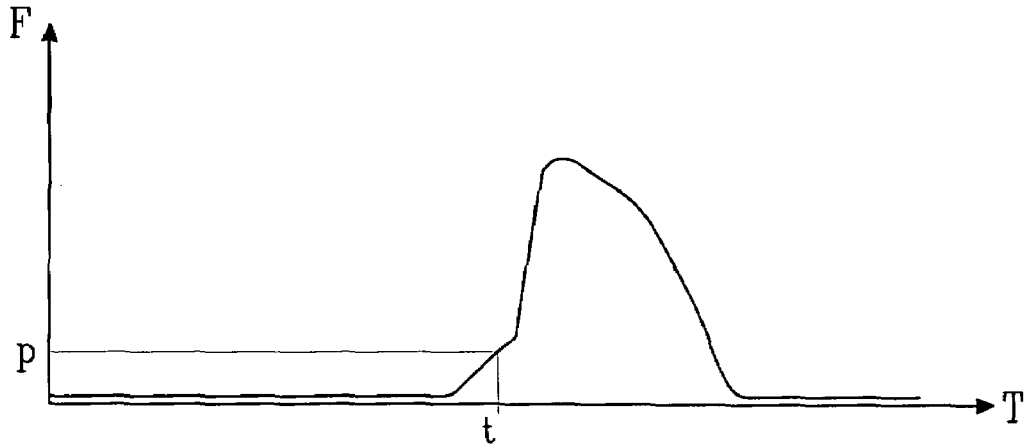
FIG. 5 illustrates a curve of the tensile force of the upper thread as a function of time, and how the point of time of the predetermined force P is decided.

The detected value of the angle of rotation B is, in the sewing machine during the process of sewing, compared to the detected value of the angle of rotation B, whereby a possible deviation is determined. Depending on how the time measure is arranged to detect the value of the point of time t, there may be a need to calculate, in the processor, the remaining thread consumption during the interval of the pull tight of the thread, which in FIG. 5 is made up of the time interval during which the increased tensile force prevails. Such a calculation of thread consumption can be performed in the processor, by means of feeding this with parameters like length of stitch, width of stitch, fabric thickness, etc. If a stiff tensile force detector is used instead of the elastic thread transfer spring 12 the point of time t may be let to be the point of time at which the knot has been completely become pulled tight, whereby any calculation of further thread consumption during the pull tight of the knot is not required.

When a measure of the deviation between A and B has been obtained, i.e. in the shown example in the form of the angle difference A−B, this measure is used to control the thread transfer member 11 in the direction of a minimizing of the deviation during sewing, i.e. that this angle difference is brought to zero.

According to the present example the thread transfer member 11 is equipped with selectable means for providing the needle 7 with desirable amount of upper thread 8. One of these means is a thread portioner. One other means is a member for friction braking of the upper thread 8.

Figure 7:
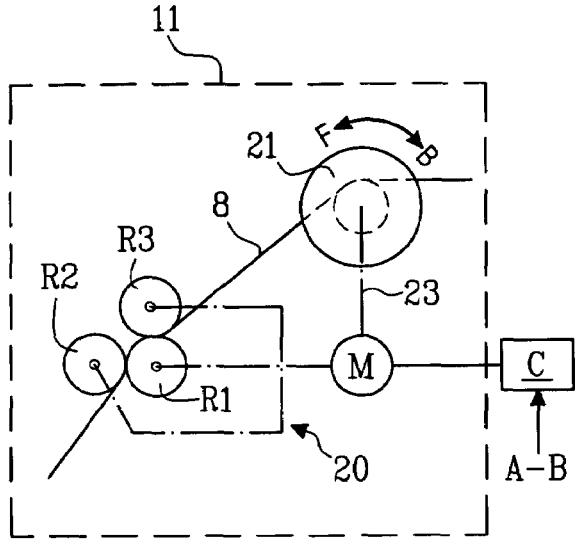
FIG. 7 schematically depicts the thread transfer member.

FIG. 7 schematically shows a thread portioner which is controlled via a processor C. In the processor C data referring to the position A, at which a knot of a stitch should be pulled tight correctly. The processor is also continuously fed with data, which indicate angle of rotation of the mechanical member on which the position B is measured, i.e. the actual value of the angle of rotation, wherein, in the present example, the angle of rotation of the second main shaft 2 is meant. The processor C is further arranged to control a step motor M, which is mechanically coupled to 3 drive rolls R1, R2, R3, via a gear mechanism indicated in the figure by 20. Herein, there is described an embodiment, wherein the motor M includes a step motor, but other types of driving members controlled in an other way than by stepping may of course be used. The upper thread is lead via disengaged friction discs 21 between the rolls R1, R2, R3, whereby stepping of the motor M implies that the upper thread 8 is fed forwards towards the needle 7 or backwards away from the needle 7. The amount of forwards or backwards transported thread is determined by the number of steps, by which the motor is stepped. The upper thread is transported forwards, when the step motor is stepped in the forward direction, indicated by Forw and is transported backwards when the motor is stepped backwards, indicated by Back. The feed is arranged to be controlled in dependence of value and sign of the measured deviation A−B. The magnitude of the value of the deviation A−B is related to the number of steps the motor M is stepped. If the deviation is positive, i.e. A−B is greater than zero, the motor will be stepped forwards. If the deviation, on the other hand, is negative, i.e. A−B is less than zero, the motor will be stepped backwards. The number of steps, by which the motor is driven forwards during a stitch is of course mainly controlled by the theoretical value of the feed that is required. However, stepping backwards can be performed by means of a limited number of steps, as otherwise, which is shown below, the thread transfer member will be brought to a neutral position.

During certain type of sewing, e.g. at free hand sewing with the sewing machine, or when the sewing machine operator so wishes, it can be impractical to use thread out portioning. In this connection the thread portioner can be switched off, by disengaging the drive rolls R2 and R3, so that these will not bear on the drive roll R1. In this way, the upper thread 8 is running freely between the drive rolls R1, R2 and R3. Instead, the sewing machine can hereby be switched to brake the upper thread by means of the member for friction braking of the upper thread 8. A switch, described below, is hereby used for disengaging the thread portioner and for activating the friction braking and vice versa. In an intermediate position, a neutral position, the switch is disengaging both the thread portioner and the friction braking. This neutral position is used, e.g. when the sewing machine is thread with the upper thread 8. The neutral position is further used as an intermediate position at a transition from thread out portioning to friction braking and at a transition from friction braking to thread out portioning.

Figure 8:
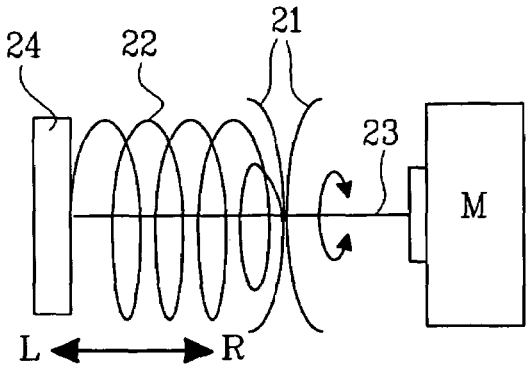
FIG. 8 shows the member for friction braking of the upper thread.

On control of the step motor M in such a way that this is rotated in the backwards direction Back, a predetermined number of steps, the thread portioner is disengaged in that the drive rolls R1, R2, R3 are separated from each other, whereas instead a spring 22 can be stretched by way of a gear 23 at continuous rotation in this direction of rotation (Back), in the way it is schematically shown in FIG. 8. When the spring 22 is stretched, in that a spring tightener 24 is being pressed in the direction R by means of force from the step motor M, the brake discs 21 for friction braking of the upper thread 8 are brought towards each other with greater force, whereby the brake force in the upper thread is increased. If a reduction of brake force of the upper thread is required, the step motor is rotated a number of steps in a reversed direction of rotation, i.e. in the direction Forw, whereby the spring tightener 24 is pressed in the direction L by the spring force of spring 22. The force by which the brake discs are bearing on each other is decreased and owing to this the brake force of the upper thread 8, running between the brake discs 21, is reduced Since the brake force acting on the upper thread 8 in the position of friction braking is regulated by means of the direction of rotation by which the step motor M is rotated and by means of the number of steps, by which the step motor M is stepped, the brake force can accordingly be controlled by means of a control of the step motor M. Through a control of the step motor M by means of the signal, which is related to the measured deviation A−B the amount of thread, which is consumed per stitch to locate the knot at the accurate position inside the sewing material, can be controlled in order to minimize the deviation A−B also when the thread transfer member 11 is in the position of friction braking of the upper thread 8. This is performed, as in the case of the switch position for thread out portioning, through a calculation of the deviation in the processor C, whereupon a trouble signal in a known automatic motorering way is sent from the processor to control the step motor M to increase or reduce the brake force acting on the upper thread 8, so that the deviation |A−B| is headed towards a minimum.

The function of a thread transfer member 11 in the form of a module, which supplies thread by means of thread out portioning or friction braking of the upper thread and which discloses a mechanism for switching between these both is explained in more detail with respect to FIGS. 9 to 13.

Figure 9:
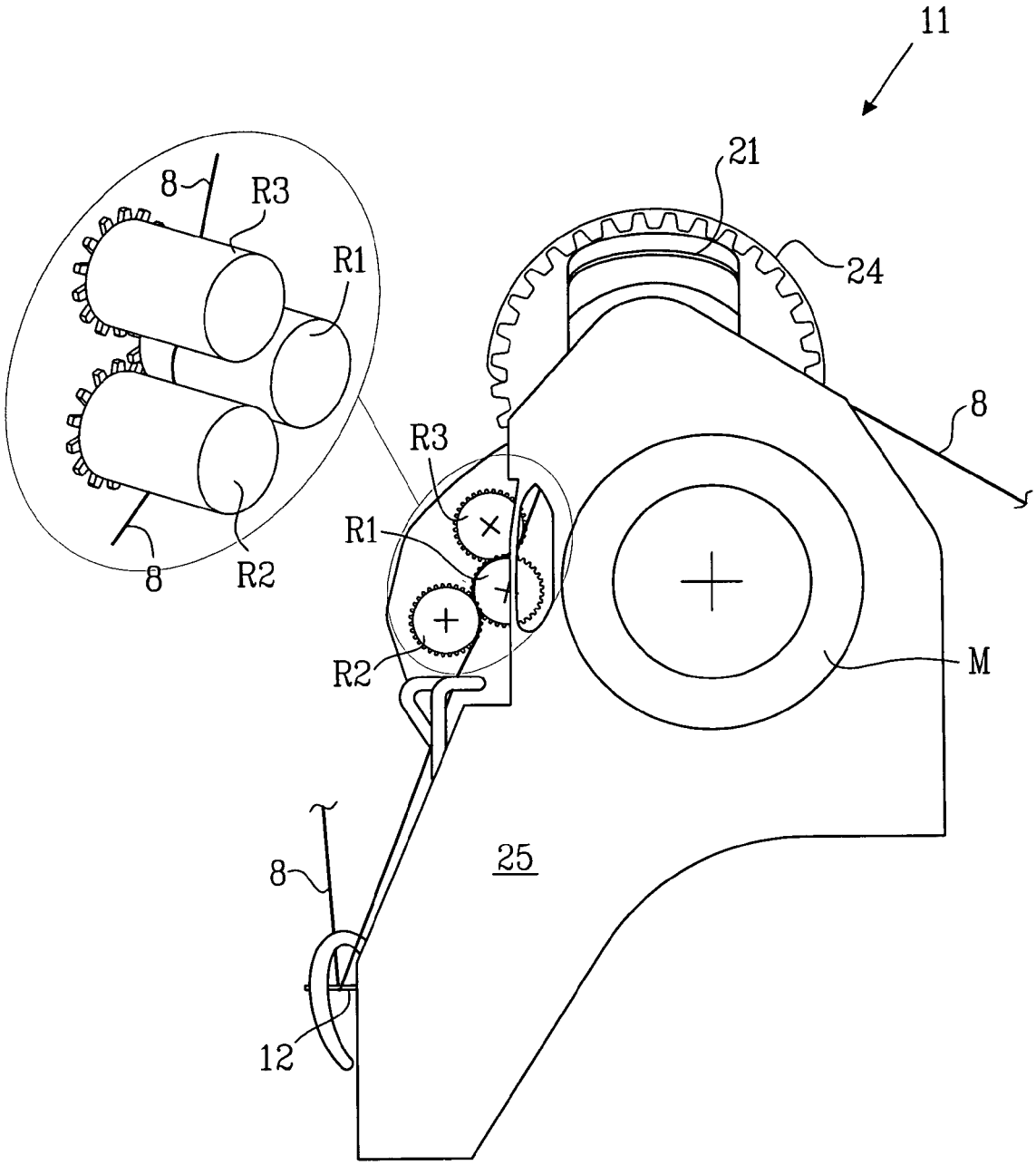
FIG. 9 shows a plane view of the thread transfer member seen from the front.

In FIG. 9 the module shows a step motor M, which via the previously mentioned gear mechanism 20, in one switch position, drives the drive rolls R1, R2 and R3. In another switch position, the step motor M drives, via the gear 23, a spring tightener 24 to increase or decrease the friction acting on the upper thread, when it is running between the disc brakes 21. It is also illustrated in the figure a detail of the point of time indicator, namely the thread transfer spring 12, around which the upper thread 8 is hooked. The mentioned element of the module are all of them mounted on a module chassis 25.

Figure 10:
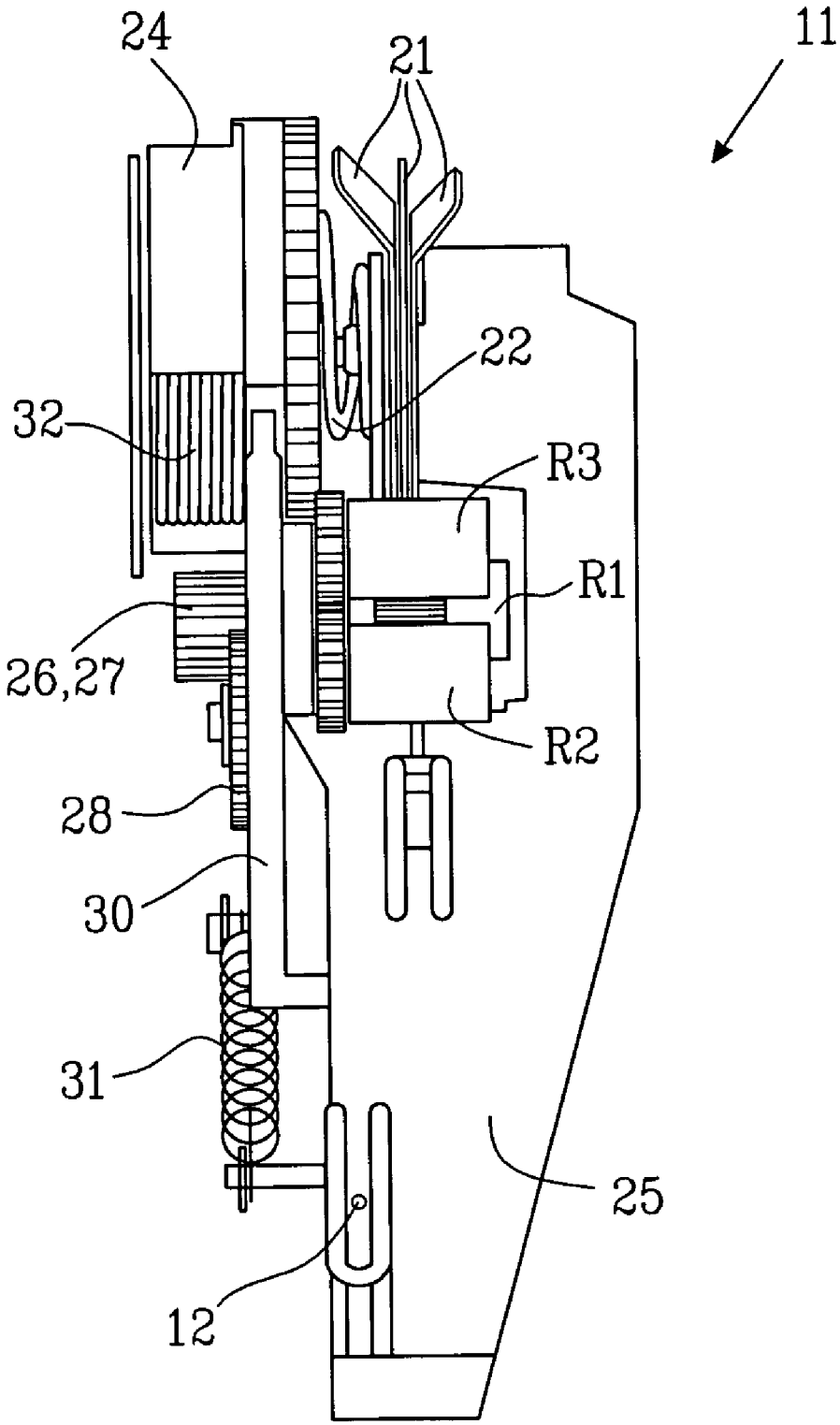
FIG. 10 shows a side view of the thread transfer member.
Figure 11:
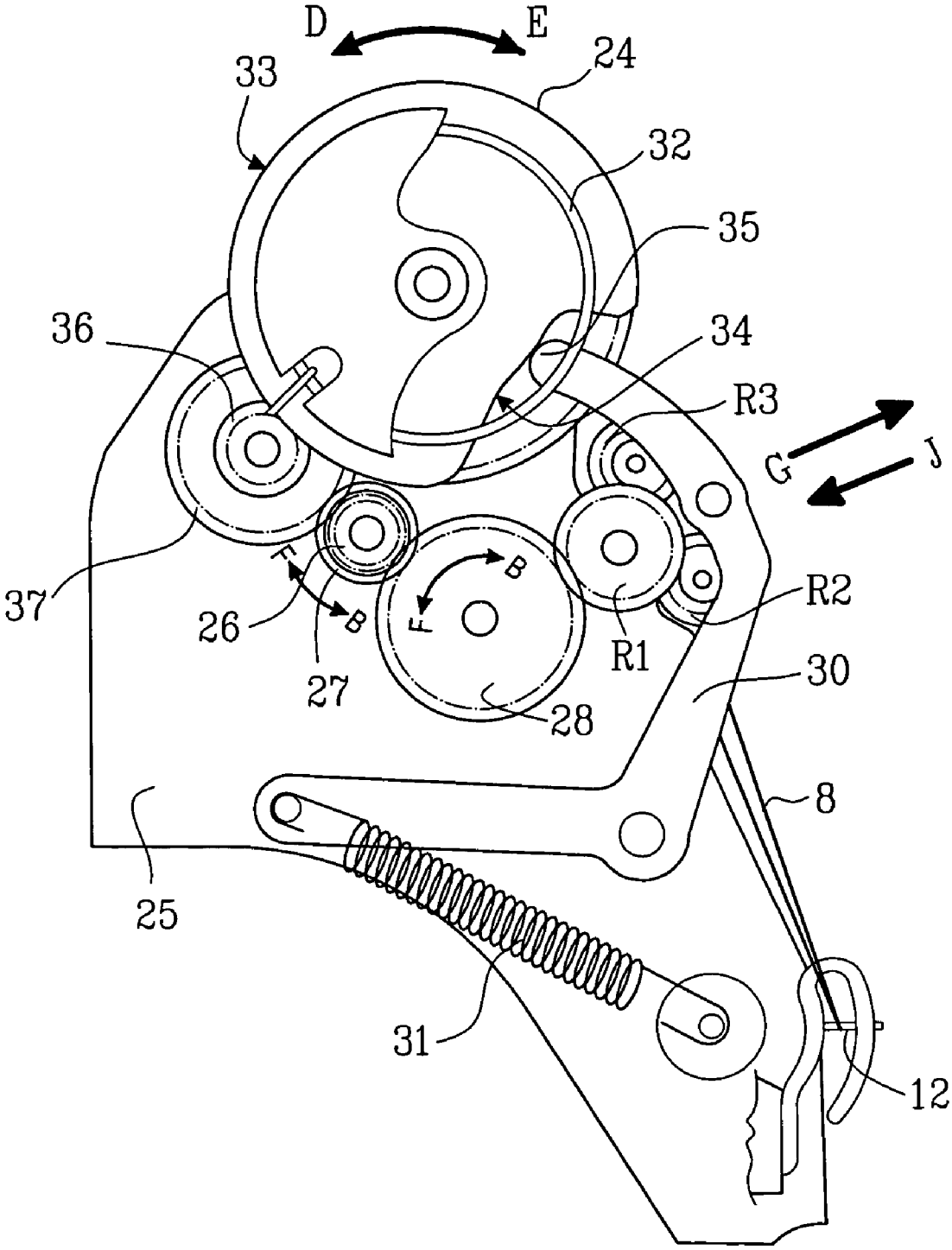
FIG. 11-13 show plane views of the thread transfer member as seen from the back side, wherein the different switching positions are illustrated.
Figure 12:
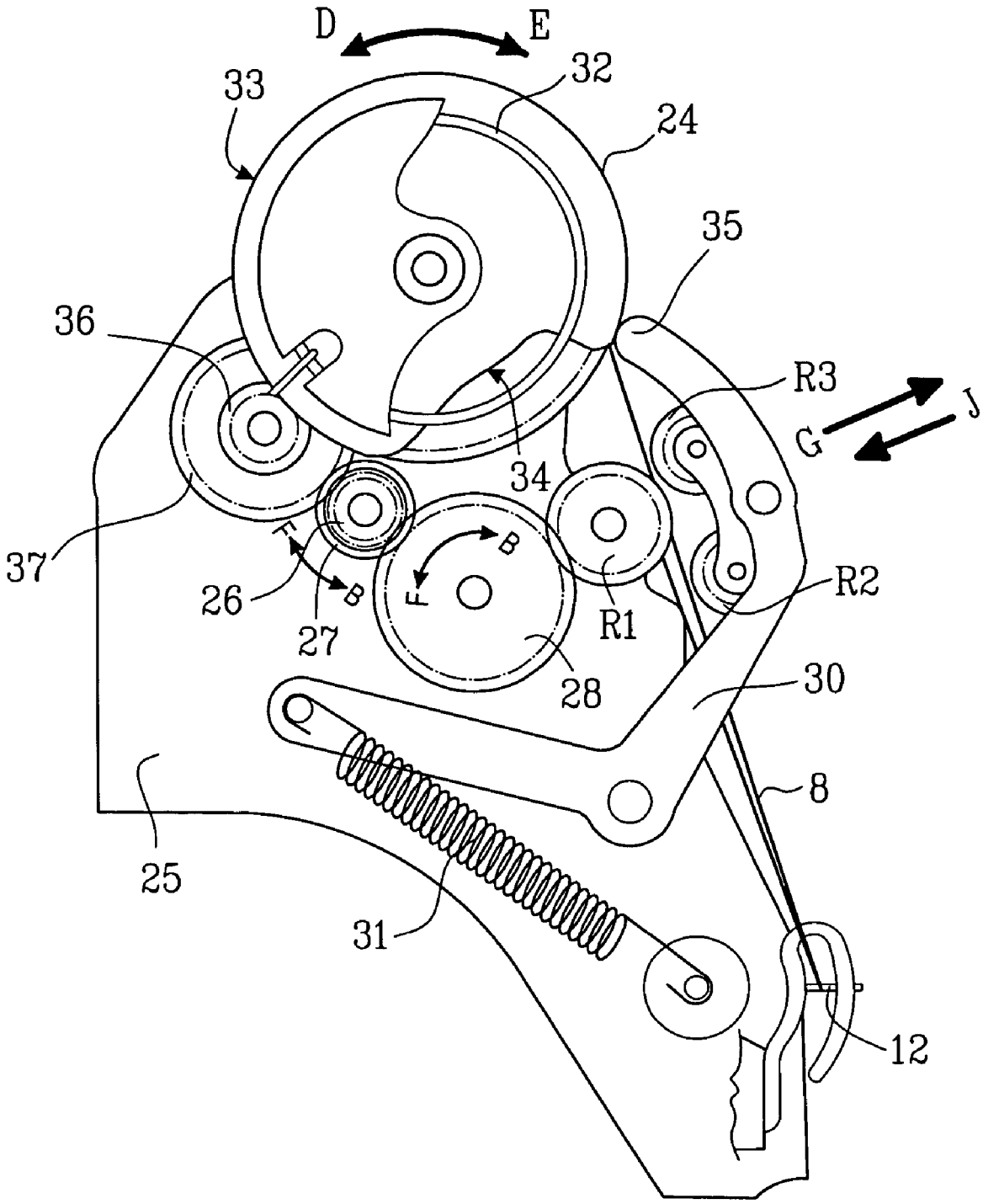
Figure 13:
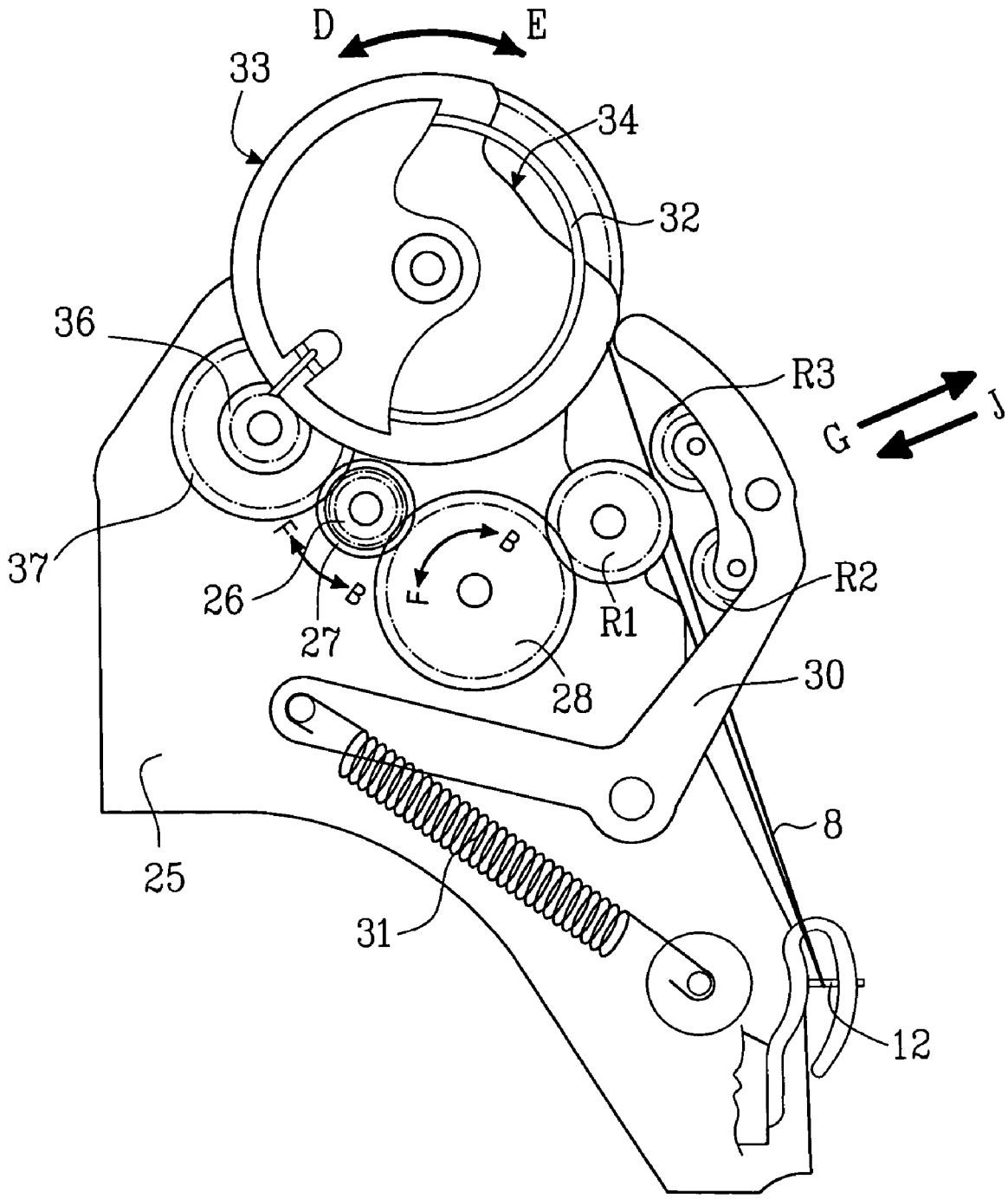

FIG. 10 illustrates in a sideview the module with the thread transfer member 11 comprising those of FIG. 9 described elements.

As mentioned, the thread transfer element 11 can be controlled to hold one of three switch positions, after this called:

Position 1: The thread out portioning position (shown in FIG. 11)

Position 2: The friction braking position (shown in FIG. 12)

Position 3: The neutral position (shown in FIG. 13)

In the thread out portioning position (position 1), the brake discs are in an open state, i.e. no braking of the upper thread 8 is obtained. A certain amount of thread is portioned out/fed out for each stitch. The feed is determined by the motor M by means of control of the motor M from the processor C of the sewing machine.

In the position for friction braking (position 2) the out portioning device is disengaged, in that the drive rolls R1, R2, R3 are disconnected from each other, so that the upper thread is freely running between them. The upper thread 8 is braked by the rake discs 21. The magnitude of the brake force is regulated by means of the step motor M through a control from the processor C.

In the neutral position (3) both of the out portioning device and the brake discs are disconnected from each other. In this position the upper thread can be thread.

On the axle of the step motor M, two gear wheels 26, 27 are mounted, of which wheels only the outer one is visible in the figures. This outer gear wheel 26 is fixedly mounted on the motor axle. The inner gear wheel 27 is mounted on a free wheel located between the inner 27 and the outer 26 gear wheel. The free wheel is fixedly mounted on the motor axle, which implies that this inner wheel 27 rotates freely in one direction of rotation of the motor M and is driven by the motor M in the other direction of rotation.

The upper thread is fed out by means of the drive rolls R1, R2 and R3, between which the thread is clamped. By a rotation of the drive rolls thread is fed out between them. The out portioning device is driven, via two intermediate wheels 28 and 29, by the outer gear wheel 25. The two additional drive rolls R2 and R3 are mounted on axles, which are attached to a first wing of a lever arm 30. A draw spring fixed between the end of the second wing of the lever arm 30 presses the drive rolls R2 and R3 against the drive roll R1, which in the figures is indicated as a direction J. In the out portioning position the brake discs are not displaced at the rotation of the motor M, since the inner gear wheel 27, which is driving the spring tightener 24, then rotates freely by means of the free wheel.

The spring tightener 24 for the adjustment of the bearing force of the brake discs 32 against each other is driven by the inner gear wheel 27 on the motor axle and by a drive spring 32 inside the spring tightener 24. The drive from the motor axle is mediated via secondary gear wheels 36, 37. The gear wheels 27, 36, 37 are included in the gear 23 depicted in FIG. 8. The spring tightener 24 comprises a cylindrical surface, which along a sector angle of the order of magnitude of ¾ of its circumference (the surface 33) has a circular cross section with a uniform radius. Along the remaining part of the circumference (the surface 34) the cylindrical surface has a depression with a smaller radius than the surface 33. In the position 2 (i.e. the friction braking position) the thread portioner is always disengaged, which is arranged in that the tip 35 of the first wing of the lever arm 30 bears on the higher surface 33 of the spring tightener 24. In this way the lever arm 30 is kept outwards in the direction G, whereby the drive roll R2 and R3 do not bear on the drive roll R1. During this position 2, the lever arm follows the curve of the surface 33, whereby the position of the lever arm will not change during position 2. When the motor M is run, so that the spring tightener 24 rotates in the direction marked by D a press washer that presses against the spring 22 will stretch this, whereby the brake discs 21 are pressed with greater force against each other, which leads to a more powerful braking of the upper thread 8, so that the tensile force in the upper thread increases.

To reduce the braking force of the upper thread 8 the press washer must be brought outwards from the brake discs 21, so that the press force from the spring 22 is decreased. A spring washer is located between the outer gear wheel 26 and the inner gear wheel 27. When the motor is run in the direction Forw, the friction between the outer 26 and the inner gear wheel causes the outer gear wheel 26 to carry the inner gear wheel 27 to rotate in the direction Forw up to a certain torque. The inner gear wheel 27 will then provide a contribution of moment, which is required to rotate the spring tightener 24 in the direction E by means of the drive spring 32. The reduction of the compressive force from the spring 22 is thus accomplished in that the drive spring 32 in combination with the friction force between the outer 26 and the inner 27 gear wheel, when the motor rotates in the Forw direction, rotates the spring tightener 24 in direction E (in the FIGS. 11-13 the direction of rotation Forw and Back are denoted with only F and B, respectively).

Due to friction in the system the drive spring 32 alone can not manage to start the drive of the movement of the spring tightener 24 in direction E. This function permits that a brake force set between the brake discs 21 remains constant, as long as the motor M is not once again run in any direction of rotation.

A switch from position 1 to position 3: The motor is controlled so that it rotates in the direction of rotation Back, when both the outer 26 and the inner gear wheel 27 are carried. The spring tightener 24 is then rotated in direction D. As the lever arm 30 follows the curve of the surface 34, the lever arm will rotate, such that the drive roll R2 and R3 are displaced in direction G. When the motor has been run, so that the tip 35 of the first wing of the lever arm 30 bears on the highest part of the surface 33, the drive roll R2 and R3 have become completely disengaged, in that they do not any longer bear on the drive roll R1.

Switch from position 3 to position 2. The motor is run in the direction of rotation Back, so that the spring tightener 24 rotates in direction D. The press washer then moves in a direction which compresses the spring 22. The spring tightener 24 is then rotated until the spring 22 starts to compress the brake discs 32.

Switch from position 2 to position 3: The motor is run in the direction of rotation Forw. The drive spring 32 will then drive the spring tigthener 24 in the direction E. When the spring tightener 24 has rotated so that the tip 35 of the lever arm 30 is situated on the border between the surface 33 and the surface 34, the press washer has been displaced a distance so far outwards from the disc brakes 21 that the intermediate spring 22 no longer compresses the brake discs 21. The brake discs are disengaged and an upper thread 8 may be thread.

Switch from position 3 to position 1: When the thread transfer member 11 is set in position 3, the tip 35 of the lever arm 30 is always located on the surface 33. The motor is run in direction Forw. The drive spring 32 will then drive the spring tightener 24, as the inner gear wheel 27, which drives the thread tightener 24 is arranged on a free wheel. The thread tightener 24 is rotated as far as its tip 35 of the lever arm lands on the lowest level of the surface 34, whereby position 1 has become occupied.

A great advantage with the disclosed embodiment is that the control of thread supply at both thread out portioning and at friction braking of the upper thread 8 can be performed by means of one and the same motor. A further advantage is that the disclosed construction makes it possible to assemble the step motor, the thread out portioning members 20, R1, R2, R3, members for friction braking 21, 22, 23, 24 and point of time indicator 13 in the same module. This modular building cheapens the construction and makes it easy to install and exchange the whole module as one separate and compact unit.

It is possible, of course, to perform the control of thread feed to the needle 7 by means of separated members for thread out portioning and friction braking, wherein each of the members is provided with a motor united for drive of the thread out portioning elements and for drive of the friction braking elements, respectively.

The sewing machine and the method at the sewing machine are above described by means of a thread feed of the upper thread at both thread out portioning and friction braking, wherein in both cases, the control can comprise a detection of a deviation between calculated thread consumption and actual thread consumption. Such a refinement is, of course, not necessary to use. The invention may be varied in such a way that a detection of the mentioned deviation is not utilized. On a more simple variant of a sewing machine than the described one, thread out portioning and friction braking according to the inventive way is allowed to be controlled only by means of calculated thread feed, wherein any detected actual thread consumption is not utilized.

The invention claimed is:

1. A sewing machine, comprising:

a needle which is provided with an upper thread;

a loop taker which houses a bobbin for a bottom thread;

a drive member which drives the needle to perform a reciprocating movement, wherein the needle during its movement and in cooperation with the loop taker executes stitches on a sewing material, which is advanced between the upper thread and the bottom thread, wherein a lever arm in each stitch pulls tight a knot being formed in the sewing material from the upper thread and the bottom thread in cooperation;

a thread transfer member which supplies the needle with upper thread utilizing a thread portioner or a friction braking assembly for braking the upper thread;

a switch for switching between thread feed utilizing the thread portioner or the friction braking assembly;

a control unit which controls the thread supply of the thread transfer member utilizing either the thread portioner or the friction braking assembly.

2. The sewing machine according to claim 1, wherein the control unit includes a processor programmed with a control program for the sewing machine.

3. The sewing machine according to claim 2, wherein the thread transfer member includes a motor, which is provided with a control signal by the processor to control the thread transfer member so that the supply of upper thread to the needle is effected by the motor M.

4. The sewing machine according to claim 3, wherein the thread transfer member includes a thread portioner, which feeds upper thread through the motor by means of a thread amount determined by the processor.

5. The sewing machine according to claim 4, wherein the thread portioner includes drive rolls bearing on each other and the upper thread and which through a gear mechanism are run by the motor to feed the determined thread amount per stitch.

6. The sewing machine according to claim 3, wherein the thread transfer member includes a friction braking assembly, an assembly which exerts a brake force on the upper thread through the motor by means of a brake force determined by the processor.

7. The sewing machine according to claim 6, wherein the friction braking assembly for friction braking the upper thread includes brake discs, which are set to exert a predetermined brake force upon the upper thread through the motor.

8. The sewing machine according to claim 7, wherein the friction braking assembly for friction braking the upper thread includes a spring tightener and a spring, whereby the motor controls the spring tightener to set a spring force of spring, so that the spring affects the brake discs to exert a calculated brake force upon the upper thread.

9. The sewing machine according to claim 1, wherein the thread transfer member is arranged to occupy one of the switch positions a) thread out portioning where supply of upper thread is performed by means of the thread portioner, b) friction braking where thread supply is performed by means of the friction braking assembly for friction braking and c) a neutral position.

10. The sewing machine according to claim 9, wherein the motor is a step motor and the switch is set to change the switch position by means of running said motor a defined number of steps.

11. The sewing machine according to claim 10, wherein the switch is controlled by a program sequence of the control program of the processor, wherein an operator's choice of seam or choice of neutral position is fed to the processor which is programmed to switch the gear position to be in neutral position or thread portioning position or the position for friction braking in dependence of said operator's choice.

12. The sewing machine according to claim 11, wherein the control unit controls the thread supply from the thread transfer member, so that a deviation between the calculated amount of thread consumption per stitch and a detected thread consumption per stitch is brought to zero.

13. The sewing machine according to claim 12, wherein the drive member of the sewing machine through coupling elements actuates a number of mechanical elements, of which the needle is one of said mechanical elements, to perform synchronously cyclic movements among themselves, wherein said deviation is detected by means of a sensor function which detects the deviation between:

a first position for a selected mechanical element being a set value for the position at a point of time, wherein a predetermined value for the tensile force in the upper thread is reached at pull tight of a knot, and a second position for the selected mechanical element being an actual value for the position at the point of time, wherein the predetermined value for the tensile force in the upper thread is reached at pull tight of the knot.

14. The sewing machine according to claim 13, wherein the sensor function includes a time sensor for determining the point of time, when the actual value of the second position for the selected mechanical element is read.

15. The sewing machine according to claim 14, wherein the selected mechanical element comprises a mechanical element from the group: a first main shaft, a second main shaft, a take-up lever, the needle, a linearly movable element driven by the drive member of the sewing machine, an element driven by the drive member of the sewing machine to oscillate about a point of rotation.

16. The sewing machine according to claim 15, wherein the selected mechanical element comprises the second main shaft of the sewing machine.

17. The sewing machine according to claim 15, wherein the time sensor includes a tensile force detector for detecting a change of the tensile force in the upper thread.

18. The sewing machine according to claim 17, wherein the tensile force detector includes a spring, which is stretched by the upper thread.

19. The sewing machine according to claim 18, wherein the spring is coupled to a flag, which changes position when the spring is stretched.

20. The sewing machine according to claim 19, wherein the time sensor includes a light beam, which is blocked by the flag on the point of time, when the predetermined tensile force in the upper thread is present.

21. The sewing machine according to claim 20, wherein the time sensor includes a light detector which transmits a signal to a processor of the control unit, wherein said signal contains information about the point of time.

22. The sewing machine according to claim 20, wherein the processor has a position sensor for reading the position at the point of time.

23. The sewing machine according to claim 22, wherein the thread portioner, the friction braking assembly for friction braking and the motor are assembled to a module which is mountable to the sewing machine or demountable from the sewing machine as one unit.

24. The sewing machine according to claim 23, wherein the time sensor is integrated in said module.

25. A method of a sewing machine including:

supplying an upper thread to a needle with a thread transfer member, accommodating a bobbin for a bottom thread with a loop taker, driving a needle with a drive member to perform a to and fro movement, performing a stitch on a sewing material during movement of the needle and the bobbin in cooperation, wherein the sewing material is advanced between the upper thread and the bottom thread;

pulling tight a knot in the stitch by a take-up lever for forming a knot in the sewing material from the upper thread and the bottom thread in cooperation;

feeding with the thread transfer member upper thread to the needle by means of portioning out a certain amount of thread per stitch or by means of friction braking of the upper thread;

switching with a switch between thread supply by means of thread out portioning and thread supply by means of friction braking;

calculating in a control unit of the sewing machine the consumption of upper thread per stitch at the selection of thread portioning out; and controlling with the control unit the supply of thread the consumption of upper thread per stitch at both the alternatives thread portioning out and friction braking.

26. The method according to claim 25, further comprising:

arranging the thread transfer member to occupy one of the switch positions: thread out portioning, friction braking and a neutral position.

27. The method according to claim 26, further comprising:

arranging the switch to change gear position by means of running a step motor a defined number of steps in a first or a second direction of rotation.

28. The method according to claim 27, further comprising:

programming a processor, included in the control unit, with a control program for the sewing machine and controlling the switch by means of a program sequence in the control program of the processor, wherein a selection of seam or a selection of neutral position made by an operator is fed to the processor which is programmed to a selection of the type of thread supply or the neutral position in dependence of said selection made by the operator.

29. The method according to claim 28, further comprising:

controlling the thread transfer member by means of the processor to switch from the thread portioning out position to the neutral position by a rotation of the step motor a defined number of steps in the second direction of rotation.

30. The method according to claim 28, further comprising:

controlling the thread transfer member by means of the processor to switch from the neutral position to the friction braking position by a rotation of the step motor a defined number of steps in the second direction of rotation.

31. The method according to claim 28, further comprising:

controlling the thread transfer member by means of the processor to switch from the friction braking position to the neutral position by a rotation of the step motor a defined number of steps in the first direction of rotation.

32. The method according to claim 28, further comprising:

controlling the thread transfer member by means of the processor to switch from the neutral position to the thread portioning out position by a rotation of the step motor a defined number of steps in the first direction of rotation.

33. The method according to claim 25, further comprising:

controlling the thread supply from the thread transfer member so that a deviation between the calculated consumption and a detected consumption of upper thread per stitch is brought to zero.

34. The method according to claim 33, wherein the sewing machine further includes a drive unit which through coupling elements affects a number of mechanical elements, of which the needle is such a mechanical element, to perform synchronously cyclic movements among themselves, the method further comprising:

detecting the deviation between:

a first position of a selected mechanical element being a set value for the position at a point of time where a predetermined value of a tensile force in the upper thread is reached at pull tight of a knot and a second position of the selected mechanical element being an actual value for the position at a point of time t where the predetermined value of the tensile force in the upper thread is reached at pull tight of the knot.

35. The method according to claim 34, further comprising:

reading the point of time by means of a time sensor; and reading the point of time for the actual value of the position.

36. The method according to claim 35, further comprising:

detecting the point of time t at a predetermined value of the tensile force in the upper thread.

37. The method according to claim 36, further comprising:

reading the angle of rotation in relation to a reference angle of one main shaft of the sewing machine by means of a processor of the control unit at the point of time and using said reading as a basis for the determination of the actual value.

38. The method according to claim 37, further comprising:

controlling the motor through the processor by means of a control signal which arranges a thread transfer member to feed upper thread to the needle so that the absolute value of the deviation between the first position and the second position is minimized.

39. The method according to claim 38, further comprising:

controlling by means of the motor a thread portioner being arranged in the thread transfer member to deliver upper thread to the needle in an amount being a function of a motor parameter, such as a number of steps run by the motor.

40. The method according to claim 38, further comprising:

controlling the thread transfer member by means of the motor to deliver upper thread to the needle, by means of friction braking of the upper thread, in an amount being a function of a motor parameter, such as a number of steps run by the motor.

41. The method according to claim 40, wherein said motor is a step motor, the method further comprising:

controlling the motor by means of a processor to run a number of steps, the number of steps being proportional to the calculated thread consumption and the deviation between the first position and the second position.

* * * * *